US005970990A

United States Patent [19]

Dunton et al.

[11] Patent Number: 5,970,990

[45] Date of Patent: Oct. 26, 1999

[54] COSMETICS CONTAINER CAP WITH APPLICATOR AND COMB

[75] Inventors: David P. Dunton, Stratford, Conn.; Robert Le Bras-Brown, New York, N.Y.; Jeffrey Mizell, Effort, Pa.; Dominic A. Paratore, Carlisle, Mass.; James Thalheimer, Toms River, N.J.

[73] Assignees: The Brideport Metal Goods Mfg. Co., Bridgeport, Conn.; Revlon Consumer Products Corporation, New York, N.Y.

[21] Appl. No.: 09/189,291

[22] Filed: Nov. 10, 1998

[51] Int. Cl.[6] ..... A45D 40/26

[52] U.S. Cl. ..... 132/218; 132/313; 132/317; 132/320; 15/185; 15/105; 401/126; 401/129; 401/37; 401/39

[58] Field of Search ..... 132/218, 120, 132/121, 129, 317, 313, 320, 148; 401/126, 129, 37, 38, 39; 15/105, 184, 185

[56] References Cited

U.S. PATENT DOCUMENTS

| | | | |
|---|---|---|---|
| D. 183,674 | 10/1958 | Bau . | |
| D. 287,168 | 12/1986 | Kingsford et al. . | |
| D. 370,302 | 5/1996 | Healy . | |
| 734,769 | 7/1903 | Stanley . | |
| 1,185,617 | 6/1916 | Scheiber . | |
| 1,196,959 | 9/1916 | Lawerenz . | |
| 1,386,344 | 8/1921 | Lund . | |
| 2,086,403 | 7/1937 | Cusack . | |
| 2,399,660 | 5/1946 | Boulicault | 15/185 |
| 2,829,655 | 8/1958 | Bau . | |
| 2,850,753 | 9/1958 | Pelletier | 15/185 |
| 3,071,143 | 1/1963 | Bau . | |
| 3,073,320 | 1/1963 | Seaver . | |
| 3,337,901 | 8/1967 | Schefer et al. . | |
| 3,763,870 | 10/1973 | Montgomery et al. . | |
| 3,764,221 | 10/1973 | Solenghi | 401/129 |
| 3,896,823 | 7/1975 | Spatz . | |
| 3,921,650 | 11/1975 | Montgomery . | |
| 4,810,122 | 3/1989 | Cole | 132/218 |
| 4,886,080 | 12/1989 | Cole . | |
| 5,007,442 | 4/1991 | Hirzel . | |
| 5,116,154 | 5/1992 | Fulkerson . | |
| 5,188,472 | 2/1993 | Sgro . | |
| 5,382,107 | 1/1995 | Nian | 15/185 |
| 5,391,011 | 2/1995 | Gueret . | |

*Primary Examiner*—Gene Mancene
*Assistant Examiner*—Pedro Philogene
*Attorney, Agent, or Firm*—Ware, Fressola, Van Der Sluys & Adolphson LLP

[57] ABSTRACT

A mascara container has a bottle for receiving a supply of mascara and defining a bottle neck and opening. A cap is removably secured to the bottle neck at a closure end of the cap, the cap having a comb end extending from the closure end to a top end of the cap and defining a comb slot therebetween. An applicator is mounted to the closure end of the cap and extends through the bottle opening when the cap is secured on the bottle neck. A comb has teeth sized for combing eyelashes, and the comb pivotally mounted to the comb end of the cap for pivotal movement between a closed position with the teeth stored in the comb slot and an open position with the teeth deployed for combing action. The comb is removably retained in the comb slot by snap engagement and is provided with an extending grip for manipulating the comb.

25 Claims, 4 Drawing Sheets

COSMETICS CONTAINER CAP WITH APPLICATOR AND COMB

FIELD OF THE INVENTION

The invention herein relates to a cosmetics container for mascara and more particularly to a cosmetics container cap with an applicator for applying mascara to the user's eyelashes and a comb for separating the user's eyelashes or combing the user's eyebrows.

BACKGROUND OF THE INVENTION

Mascara is a commonly used cosmetics product. It is applied to the eyelashes to provide the eyelashes with a thicker, lusher appearance. Mascara is generally provided in an elongated bottle having a cap, and the cap generally mounts an applicator which extends into the bottle when the cap is secured thereon. The cap functions as a handle for removing the applicator and manipulating the applicator in transferring mascara to the eyelashes.

Mascara applicators have taken a variety of forms and structures in the prior art. Perhaps the most common mascara applicator is a rod mounted to extend from the cap of the mascara container, with a brush positioned at the distal end of the rod. The brush is typically formed by a twisted wire stem embracing bristles that extend radially outwardly. The variation in the number of bristles, the size and stiffness of the bristles, profiling of the applicator brush, and many other features are provided in the prior art to enhance the application of mascara to the eyelashes.

The prior art also encompasses other types of applicators, including foam pads, threaded rods, flocked tips, and shaped plastic parts, all designed to transfer mascara from the applicator to eyelashes.

An additional aspect of mascara container art involves the provision of a wiper diaphragm at the opening to the bottle of the cosmetics container, for wiping excess mascara from the applicator as the applicator is withdrawn from the bottle. With the proper combination of applicator and wiper, the amount of mascara remaining on the applicator after wiping will optimize the transfer of mascara to the eyelashes.

Eyelashes have the most pleasing appearance when they are separated and fully extended. One problem with mascara applicators is that although they successfully apply mascara to the eyelashes and thereby enhance the color and thickness of the eyelashes, the applied mascara can cause adjacent eyelashes to stick together. Therefore, one of the objects in designing mascara applicators is to separate the eyelashes as the mascara is being applied. However, applicator is stored in the mascara, the applicator always performs as an applicator of mascara rather than a separator of eyelashes.

Accordingly, there is a need for an improved cosmetics container which achieves both application of mascara to the eyelashes and separation and definition of the eyelashes after the mascara has been applied and, if desired, combing of the eyebrows.

SUMMARY OF THE INVENTION

It is a principal object of the invention herein to provide for improved application of mascara to the eyelashes.

It is a further object of the invention herein to provide for the convenient and efficient use of mascara to enhance appearance of eyelashes.

It is another object of the invention herein to provide a cosmetics container that both applies mascara to the eyelashes and separates and defines the eyelashes.

It is another object of the invention to provide a cosmetics container with the foregoing capability of applying mascara and separating and defining the eyelashes, and which is easy to use.

It is a further object of the invention to provide a cosmetic container having the above features and which is compact and sleek in its external appearance.

According to the invention herein, there is provided a cosmetics container having a bottle for receiving and storing a supply of mascara, the bottle having a neck defining an opening into the bottle. A cap is removably securable to the neck of the bottle at a closure end of the cap. An applicator is mounted to the closure end of the cap and extends therefrom into the bottle when the cap is secured on the bottle neck. The cap extends from its closure end to a distal end with the cap defining a comb slot therebetween. A comb including a plurality of teeth is mounted to the cap for movement between a comb storage position with the teeth stored in the comb slot and a combing position with the teeth deployed for combing action. The applicator is used to apply mascara to the eyelashes and the comb is used to separate and define the eyelashes after application of the mascara.

According to additional aspects of the invention, the comb is pivotally mounted to the cap for pivotal movement from the storage position to the combing position. The comb may be pivotally mounted to the cap adjacent the distal end of the cap, and extend beyond the distal end of the cap when the comb is open for combing action. In the combing position, a comb line defined by the ends of the teeth of the comb diverges from the axis of the cap, for easy placement of the comb to the eyelashes.

According to other aspects of the invention, the aligned teeth of the comb extend from a comb spine, and the teeth and at least a portion of the spine extend into the comb slot when the comb is received in the cap. A grip protrudes from the spine, and extends outwardly from the cap for grasping and pivoting the comb toward its combing position. The comb is held in its storage position by an interengaging snap fit between the comb and the cap, and the comb has a stop tab establishing its storage position and interengaging fit with respect to the cap. The grip is preferably arcuate.

According to further aspects of the invention, the spine includes a tail segment which separates the teeth of the comb from the distal end of the cap when the comb is in its combing position. The tail segment includes a pivot stop which supports and holds the comb in its combing position.

According to still further aspects of the invention, the cap has a tubular sidewall adjacent its distal end, and the spine of the comb is mounted to a circular mounting panel that is pivotally mounted within the tubular side wall of the cap, the mounting panel providing a top wall of the cap when the comb is pivoted to its storage position. The mounting panel is provided with mounting pins that are preferably beveled to cooperate with guideways and pin openings formed in the tubular side wall of the cap to facilitate installing the comb on the cap.

Other and more particular objects and features of the invention herein will be in part understood by those skilled in the art and will in part appear in the following description of the preferred embodiment, taken together with the drawings.

BRIEF DESCRIPTION OF THE DRAWINGS

The same reference numerals refer to the same elements throughout the various figures.

DESCRIPTION OF PREFERRED EMBODIMENT

Figure 3:
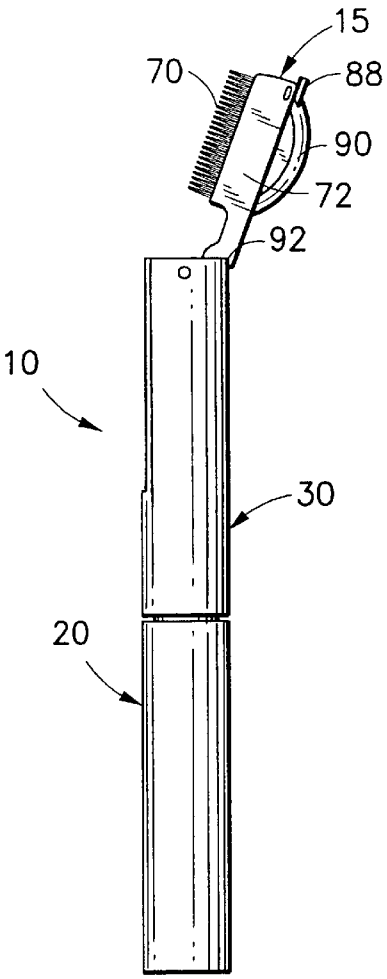
FIG. 3 is a side view of the cosmetics container of FIG. 1, with a comb thereof extended to a combing position.

A cosmetics container 10 according to the invention herein is adapted to apply mascara to eyelashes, and to separate and define eyelashes having mascara applied thereto by means of a comb 15. With reference to FIGS. 1–4, the cosmetics container 10 generally comprises a bottle 20 having an elongated reservoir 22 and a threaded neck 24 defining an entrance opening 26 to the interior of the reservoir 22. The threaded neck 24 supports a flexible wiper diaphragm 28 having a wiper orifice 29 which further defines the entrance opening 26 to the reservoir 22.

Any orientations referred to in the description of the cosmetics container 10, such as top, bottom or side, are generally taken with reference to the orientation of the cosmetics container and its parts in FIGS. 1–5.

The cosmetics container 10 also generally comprises a cap 30 having a closure end 32 extending from a head wall 34. The closure end 32 includes a portion of tubular side wall 36 that defines internal threads 38 for securing the cap 30 to the threaded neck 24 of the bottle 20. An applicator 40 includes a rod 42 extending axially from the closure end 32 of the cap 30, the rod 40 being mounted in the closure end 32 by an integral mounting plug 44 press fit into the tubular side wall 36 of the closure end 32 between head wall 34 and the threads 36. The applicator 40 is provided with a brush 46, which is preferably of the type having a twisted wire stem 47 capturing a plurality of radially extending bristles 48, which may be shaped in an elongated truncated conical profile. It will be appreciated that various brushes and mascara application means other than brushes may be used in the cosmetics container 10.

Figure 2:
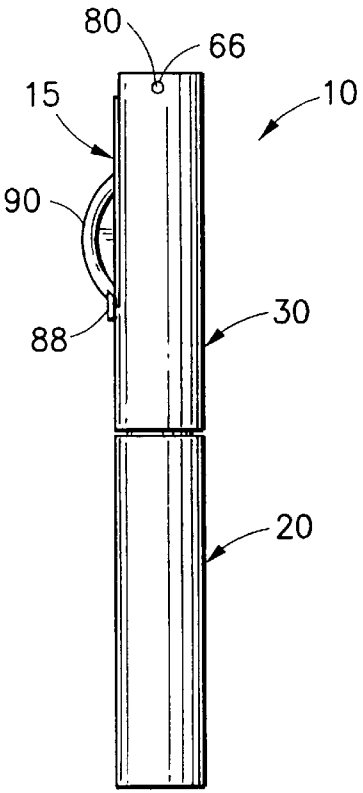
FIG. 2 is another side view of the cosmetics container of FIG. 1.
Figure 1:
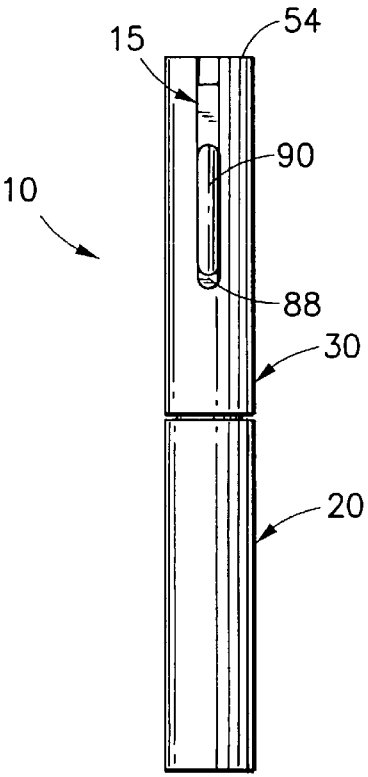
FIG. 1 is a side elevation view of a cosmetics container according to the invention herein.
Figure 4:
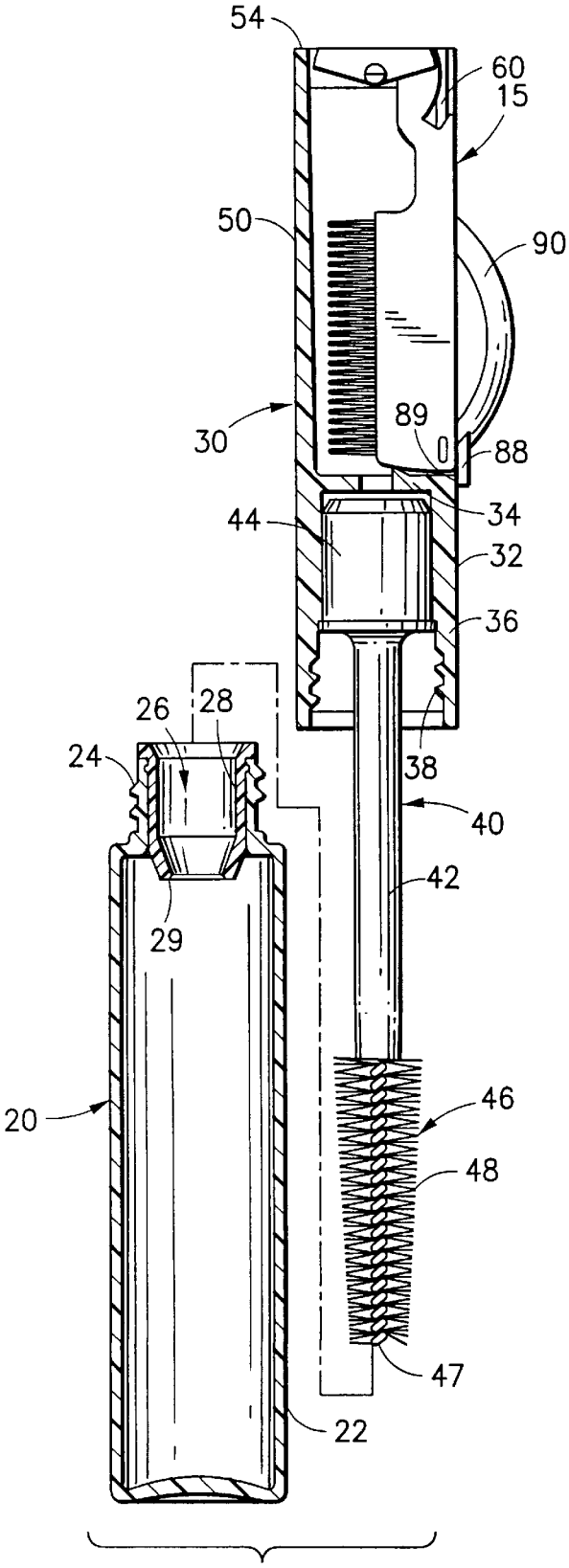
FIG. 4 is a side view, partially in section, of the cosmetics container of FIG. 1 with a cap thereof removed.
Figure 5:
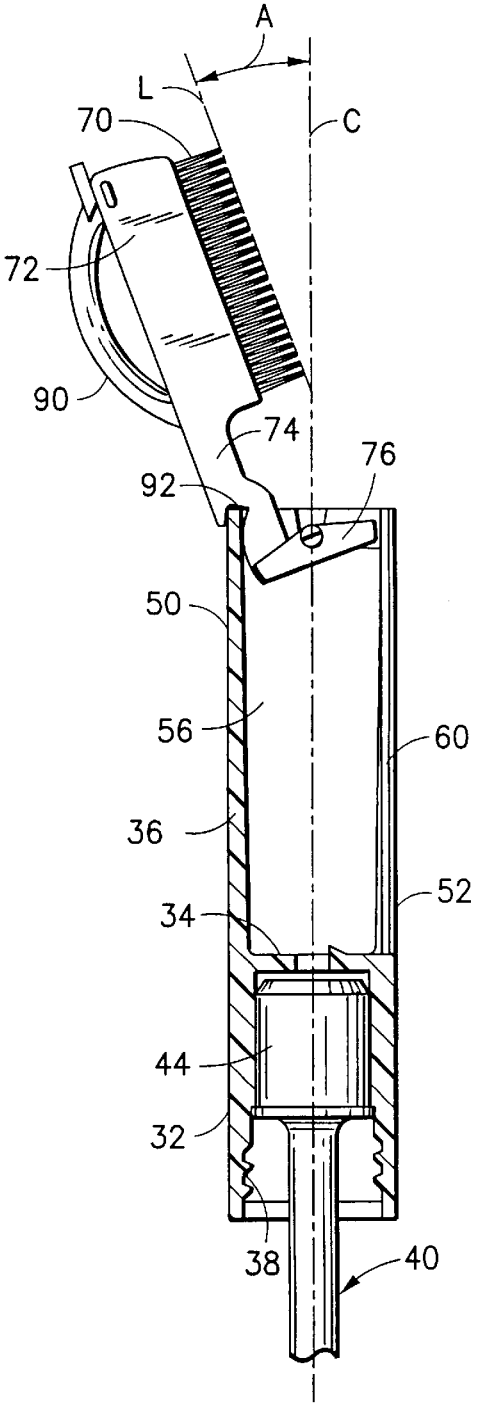
FIG. 5 is a side view, partially in section and partially cut away, of the cap of the cosmetics container of FIG. 1 with the comb thereof in its combing position.

The cap 30 of cosmetics container 10 has a comb end 50, and comb 15 is pivotally mounted to the cap 30 for pivotal movement between a first, storage position wherein the comb is substantially stored in comb end 50 of the cap 30, and a second, combing position with the comb 15 deployed for combing action. Although the comb 15 is pivotally mounted to the cap 30, it will be understood that other ways of mounting the comb for movement between a storage position and a combing position may be used. With reference to FIGS. 1, 2 and 4, the cosmetics container 10 is shown with its comb 15 in the storage position, and FIGS. 3 and 5 illustrate the cosmetics container 10 with the comb in its deployed, combing position. Thus, in the cosmetics container 10 the comb 15 is pivotally mounted to the distal or top end 54 of the cap 30.

Figure 9:
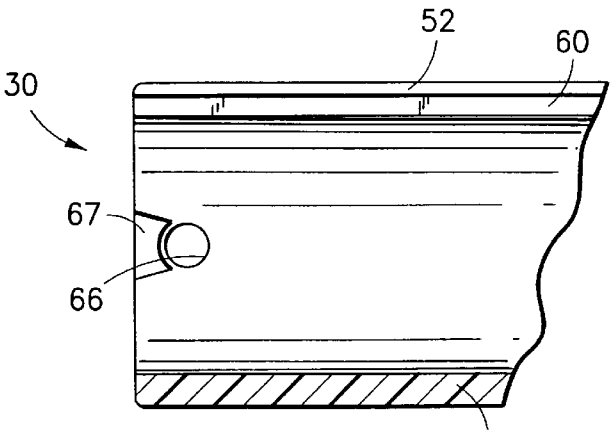
FIG. 9 is another fragmentary sectional view of the distal end of the cap of the cosmetics container of FIG. 1.
Figure 6:
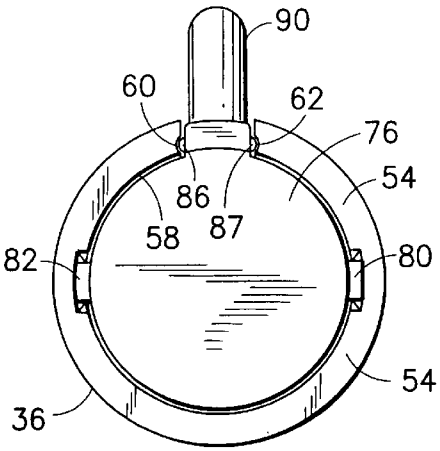
FIG. 6 is a top view of the cosmetics container of FIG. 1.
Figure 8:
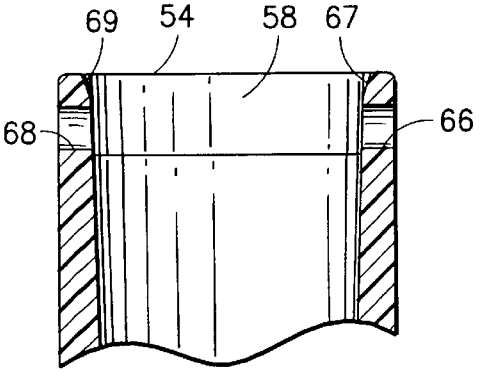
FIG. 8 is a fragmentary sectional view of the distal end of the cap of the cosmetics container of FIG. 1.

With reference to FIGS. 4 and 5, the comb end 50 of the cap 30 includes the portion of the tubular sidewall 36 extending from the head wall 34 to the top end 54. The comb end 50 therefore has an interior cavity 56 and a round opening 58 at the top end 54. A comb slot 52 is provided in the comb end 50, the comb slot 52 extending through the cylindrical side wall 36 and into the interior cavity 56 of the comb end 50, which forms an enlarged portion of the comb slot 52. The portion of the comb slot 52 defined by the tubular side wall 36 of the comb end 50 defines detent grooves 60 and 62 which cooperates with the comb 15 to secure the comb 15 in its storage position, as more fully discussed below. The detent grooves 60 and 62 extend the entire length of the comb slot 52, for ease of molding. With reference to FIGS. 6, 8 and 9, the cap 30 defines two diametrically opposed pin openings 66 and 68, adjacent the top end 54, and the pin openings at 66, 68 are respectively provided with guideways 67, 69 extending from the top end 54 to the openings.

Figure 7:
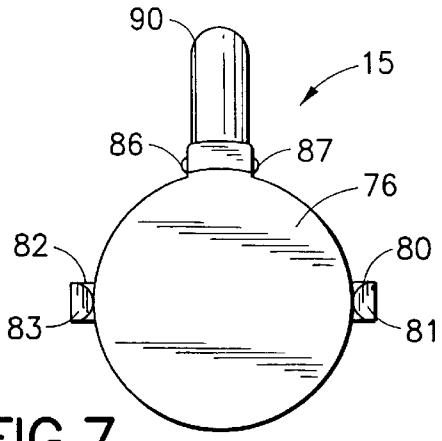
FIG. 7 is an end view of the comb of the cosmetics container of FIG. 1.
Figure 11:
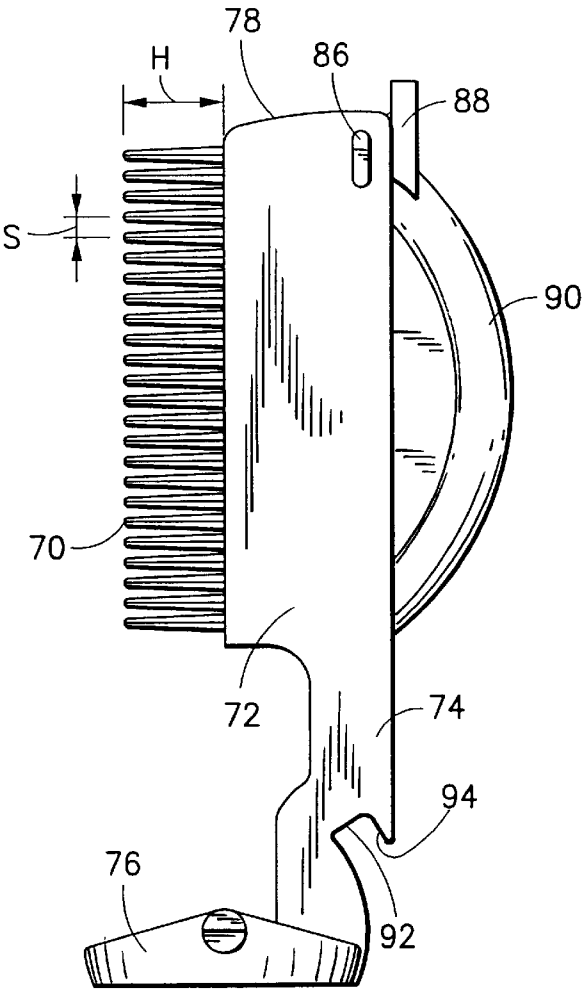
FIG. 11 is a side elevation view of the comb of the cosmetics container of FIG. 1.
Figure 10:
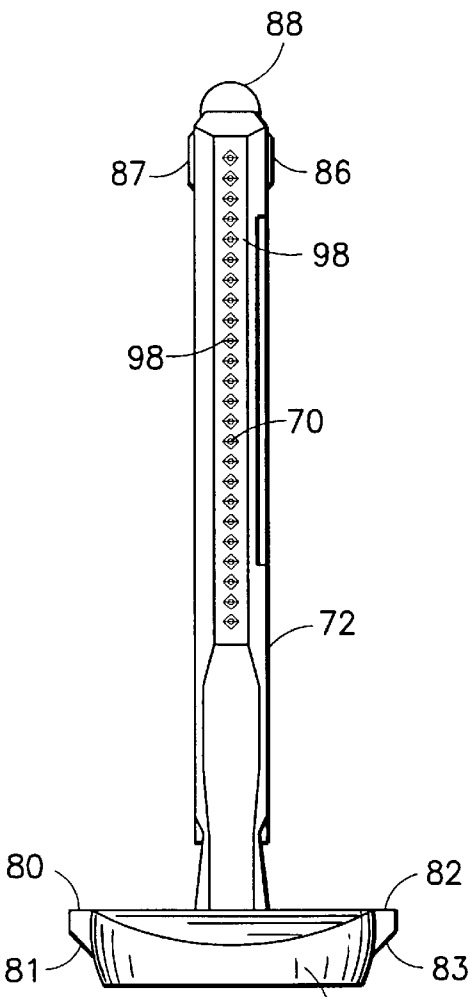
FIG. 10 is a bottom view of the comb of the cosmetics container of FIG. 1.

The comb 15, shown separately from the container 10 in FIGS. 7, 10 and 11, includes a plurality of aligned, spaced-apart teeth 70 extending from a spine 72. The spine 72 includes a tail segment 74 which is secured to a mounting panel 76. The mounting panel 76 is generally circular when viewed from its end, as shown in FIG. 7, and is sized to substantially fill the opening 58 at the top end 54 of the cap 30. A pair of pivot pins 80 and 82 extend diametrically outwardly from the mounting panel 76, and are received in the pin openings 66 and 68 of the comb end 50 to mount the comb 15 to the cap 30. The pivot pins 80, 82 are respectively provided with beveled lead edges 81, 83, that cooperate with the guideways 67, 69 for inserting the pivot pins 80, 82 in the pin openings 66, 68.

At the free end 78 of spine 72, the spine 72 defines two flanking retention bumps 86 and 87, best seen in FIGS. 10 and 11, and also defines a stop tab 88. When the comb 15 is pivoted to its storage position, shown in FIGS. 1, 2, 4 and 6, the retention bumps 86 and 87 are respectively received in the detent grooves 60, 62 defined at the opening of the comb slot 52. The stop tab engages the exterior of the cap 30 at 89, and prevents the comb from being pivoted past the engagement of the retention bumps in the detent grooves. Thus, the comb 15 is securely held in the desired stored position shown in FIGS. 1, 3, 4 and 6. As best seen in FIG. 6, the mounting panel 76 of comb 15 provides a top wall of the cap 30 when the comb 15 is in its storage position.

The comb 15 also includes a curved grip 90 which extends from the spine 72 opposite the teeth 70. With reference to FIGS. 2 and 4, the grip 90 is exposed outside the cap 30 when the comb 15 is in its storage position, and the grip 90 may be grasped and pulled to release the comb from detent grooves 60, 62 and pivot the comb 15 to its combing position, shown in FIGS. 3 and 5. The curved, arcuate shape of the grip 90 provides a relatively smooth transition between the exterior of the cap 30 and the grip 90 so that the grip 90 does not catch or snag with other articles that may be kept near the cosmetics container 10, such as the user's purse.

The tail segment 74 of spine 72 defines a pivot stop 92 in a generally rectangular slot 94 positioned to receive the side wall 36 of comb end 50, as best seen in FIGS. 3 and 5. The pivot stop 92 retains the comb 15 in its combing position. The retaining action is achieved both by butting engagement of the pivot stop 92 with the top end 54 of the cap 30 at 96, and by frictional engagement of the side wall 36 within the slot 94, i.e. pivot stop positively prevents further rotation of the comb 15 beyond the combing position shown, and the slot 94 frictionally holds the comb 15 against pivotal movement toward the storage position until the user manipulates the comb 15 toward that position.

In the combing position as shown in FIGS. 3 and 5, a comb line L formed along the aligned tips of the comb teeth 70 is pivoted beyond the axis C of the cap 30, and diverges from the axis C of the cap 30 at angle A, such that the comb is well exposed for placement to the eyelashes of a user. The angle A may be in the range of 0°–70°.

The comb 15 is provided with 24 teeth, and a range of 15–35 teeth is useful. The centerlines of the teeth are spaced apart by a distance S of approximately 0.0037 inches, and spacings in the range of 0.001 to 0.010 inches are useful in practicing the invention. The teeth 70 have a height H of a approximately 0.184 inches, and the teeth may have a height in the range of 0.100 to 0.300 inches. When viewed from their tips as shown in FIG. 10, the teeth 70 have a square cross section oriented to present corner edges 98 of the teeth as the comb is utilized. Conical and other tooth shapes are also useful. The comb 15 is preferably made of a plastic material which is relatively stiff in the dimensions of the spine 74, its tail segment 74 and mounting panel 76, but which provides flexible teeth 70 in their smaller dimensions. Acetal, nylon and other resins with similar flexural modules are suitable. The bottle 20 and cap 30 is made of (a modified acrylic polypropylene, and a variety of other plastic materials are suitable, such as polyvinyl chlorides, Zylar® a modified ABS made by Nova Chemical), polyethylene terephthalate, and the like.

The cosmetics container 10 is utilized by removing the cap 30 and withdrawing the applicator 40 from the bottle 20. Mascara is carried from the bottle on brush 58, and the rod 42 and brush 58 are wiped of excess mascara as the applicator is withdrawn. The brush 48 is used to apply mascara to the eyelashes, with cap 30 providing a handle. Thereafter the user has the option of returning the applicator 40 to the bottle 20 prior to using the comb 15, or using the comb with the cap 30 removed from the bottle 20. According to either option, the user may grasp the grip 90 to remove the comb 15 from the comb slot 52, and pivot the comb 15 to its combing position shown in FIGS. 3 and 5. The user may then grasp the cap 30, or the cap 30 and bottle 20 if the user has selected to return the cap to the bottle and manipulate the comb 15 with respect to the user's eyelashes. The comb 15 may also be used to groom the user's eyebrows, if desired.

The cosmetics container 10 including a comb 15 described above fulfills the objects of the invention herein and provides the other and additional objects that appear from the description preferred embodiment. It will appreciated that the cosmetics container 10 is illustrative of the invention, and that various changes may be made without departing from the spirit and scope of the invention, which is limited only by the following claims.

We claim:

1. A cosmetics container comprising:

A) a bottle for receiving a supply of mascara, the bottle having a neck defining a bottle opening;

B) a cap removably secured to the neck of the bottle at a closure end of the cap, the cap having a comb end extending from the closure end to a top end of the cap and defining a comb slot therebetween;

C) an applicator for applying mascara, the applicator mounted to the closure end of the cap and extending through the bottle opening into the bottle when the cap is secured on the bottle neck; and D) a comb having teeth adapted for combing eyelashes, the comb mounted to the comb end of the cap for movement between a closed position with the teeth stored in the comb slot and a combing position with the teeth deployed for combing action.

2. A cosmetics container as defined in claim 1 wherein the comb is pivotally mounted to the comb end of the cap for pivotal movement between the storage position and the combing position.

3. A cosmetics container as defined in claim 1 wherein the comb is pivotally mounted to the cap at the top end of the cap.

4. A cosmetics container as defined in claim 3 wherein the comb is removably retained in the comb slot by snap engagement between the comb and the cap.

5. A cosmetics container as defined in claim 4 wherein the comb defines a stop tab engaged with the cap when the comb is retained by snap engagement in the comb slot.

6. A cosmetics container as defined in claim 4 wherein the comb defines retention bumps received in snap engagement in detent grooves defined in the comb slot of the cap.

7. A cosmetics container as defined in claim 4 wherein the comb has an extending grip, and the comb in the storage position is substantially received in the comb slot with the grip extending therefrom for use in manipulating the comb from the storage position to the combing position.

8. A cosmetics container as defined in claim 7 wherein the grip is curved and extends from the comb slot in an arcuate configuration.

9. A cosmetics container as defined in claim 3 wherein the comb defines a pivot stop engageable with the cap to retain the comb in its combing position.

10. A cosmetics container as defined in claim 3 wherein the comb further comprises a spine, the teeth extend from the spine in an aligned row of teeth, and the spine has a tail segment extending between the teeth and the top end of the cap.

11. A cosmetics container as defined in claim 10 wherein the cap has an axis, the teeth extend to tips deployed along a comb line, and in the combing position of the comb the teeth are placed with the comb line at or diverging from the axis of the cap, exposing the teeth of the comb for combing action.

12. A cosmetics container as defined in claim 11 wherein the comb line and the axis of the cap define an angle of divergence in the range of 0°–70°.

13. A cosmetics container as defined in claim 10 wherein the comb end of the cap defines a tubular sidewall adjacent the top end of the cap, the tail segment of the spine is mounted to an end panel pivotally mounted in the tubular sidewall, and the end panel substantially covers the end of the cap when the comb is pivoted to its storage position.

14. A cosmetics container as defined in claim 13, wherein the end panel defines diametrically extending mounting pins and the cap defines diametrically opposed pin openings receiving the mounting pins of the end panel for pivotally mounting the comb to the cap.

15. A cosmetics container as defined in claim 14, wherein the diametrically opposed pin openings in the cap are provided with guideways and the mounting pins of the end panel are provided with bevels cooperating with the guideways in inserting the mounting pins in the pin openings.

16. A cosmetics container as defined in claim 10 wherein the number of aligned teeth is between 15 and 30.

17. A cosmetics container as defined in claim 16 wherein the number of teeth is 24.

18. A cosmetics container as defined in claim 10 wherein the centerlines of adjacent teeth are spaced apart in the range of 0.001–0.010 inches.

19. A cosmetics container as defined in claim 18 wherein the centerlines of adjacent teeth are spaced apart by approximately 0.0037 inches.

20. A cosmetics container as defined in claim 10 wherein the teeth have a height in the range of 0.100–0.300 inches.

21. A cosmetics container as defined in claim 20 wherein the teeth are approximately 0.184 inches high.

22. A cosmetics container as defined in claim 10 wherein the comb is fabricated of material which is substantially rigid in the dimensions of the spine and semi-rigid in the dimensions of the teeth.

23. A cosmetics container as defined in claim 22 wherein the comb is fabricated of acetyl plastic.

24. A cosmetics container as defined in claim 1 wherein the comb has an extending grip, and the comb in the storage position is substantially received in the comb slot with the grip extending therefrom for use in manipulating the comb from the storage position to the combing position.

25. A cosmetics container as defined in claim 1 wherein the comb is fabricated of material which is substantially rigid in the dimensions of the spine and semi-rigid in the dimensions of the teeth.

* * * * *

UNITED STATES PATENT AND TRADEMARK OFFICE

CERTIFICATE OF CORRECTION

PATENT NO. : 5,970,990
DATED : October 26, 1999
INVENTOR(S) : David P. Dunton et al.

It is certified that error appears in the above-identified patent and that said Letters Patent is hereby corrected as shown below:

On title page, Item [73] "Assigneees", "Brideport" should be --Bridgeport--

Signed and Sealed this

Fourth Day of July, 2000

*Attest:*

*Attesting Officer*

Q. TODD DICKINSON

*Director of Patents and Trademarks*

UNITED STATES PATENT AND TRADEMARK OFFICE

CERTIFICATE OF CORRECTION

PATENT NO. : 5,970,990
DATED : October 26, 1999
INVENTOR(S) : David P. Dunton et al.

It is certified that error appears in the above-identified patent and that said Letters Patent is hereby corrected as shown below:

On the title page, item [73] "Assignees", "Brideport" should be --Bridgeport--

Signed and Sealed this

Thirty-first Day of October, 2000

*Attest:*

Q. TODD DICKINSON

*Attesting Officer*

*Director of Patents and Trademarks*